United States Patent [19]

Hosono et al.

[11] 4,341,179

[45] Jul. 27, 1982

[54] DEVELOPING DEVICE

[75] Inventors: Nagao Hosono, Chofu; Junichiro Kanbe, Tokyo, both of Japan

[73] Assignee: Canon Kabushiki Kaisha, Tokyo, Japan

[21] Appl. No.: 124,712

[22] Filed: Feb. 26, 1980

[30] Foreign Application Priority Data

Mar. 1, 1979 [JP] Japan ..... 54-23700
Mar. 5, 1979 [JP] Japan ..... 54-25328

[51] Int. Cl.[3] ..... G03G 15/09
[52] U.S. Cl. ..... 118/658; 118/657
[58] Field of Search ..... 118/658, 657

[56] References Cited

U.S. PATENT DOCUMENTS 4,254,202 3/1981 Matsumoto ..... 118/658

*Primary Examiner*—Bernard D. Pianalto
*Attorney, Agent, or Firm*—Fitzpatrick, Cella, Harper & Scinto

[57] ABSTRACT

The present invention provides a developing device for conducting image development with the use of a magnetic developer containing magnetic powder in a proportion not less than 20 wt. % and having a mean particle size not less than 5 microns and with a magnetic field of which flux density is not in excess of 950 gauss at the surface of the developer supporting member. Also the developing device is provided with developer leak preventing members, a developer recovering magnetic pole at an angular position $\theta 1$ ($<45°$) downstream of the initial contact position of the preventing members with the developer supporting member and another magnetic pole at angular position $\theta 2$ ($<\theta 1$) upstream of the initial contact position.

30 Claims, 3 Drawing Figures

DEVELOPING DEVICE

BACKGROUND OF THE INVENTION

1. Field of the Invention

The present invention relates to a developing device utilizing a one-component developer containing magnetic toner.

2. Description of the Prior Art

In the development with a one-component developer (hereinafter also called toner) there is preferred the use of an insulating magnetic developer in order to satisfy the requirement of image transfer onto a plain paper. Also in case such insulating magnetic developer is charged at the development of a latent image there are required various factors for stabilizing the developing density and the developed image. The absence of coagulation of the developer is one of such requirements. For meeting such requirement preferred is the use of a developing method in which the developer applied on developer supporting means is charged and positioned separate from latent image bearing means, whereby the developer supported on said supporting means jumps up to the image area of the latent image. This method, effective for preventing compression and coagulation of the developer between the developer supporting means and the latent image bearing means and known as toner transfer development as disclosed in the U.S. Pat. Nos. 3,232,190 and 2,839,400, utilizes non-magnetic toner. There is also known a developing method in which an electric field of a high frequency higher than 1.5 kHz is applied between the developer supporting means and the rear face of the latent image bearing means, as disclosed in the U.S. Pat. Nos. 3,866,574 and 3,893,418. Despite of various trials, however, it has been difficult to realize a stable developing density and to constantly maintain a uniform developer layer on the developer supporting means without the coagulation of the developer.

In order to resolve such difficulties there are already proposed other developing methods different from that disclosed in the above-mentioned United States Patents. For example the United States Patent Applications Ser. Nos. 938,101, filed Aug. 30, 1978; 938,494, filed Aug. 31, 1978; 58,434, filed July 17, 1979 and 58,435, filed July 18, 1979, U.S. Pat. No. 4,292,387 of the present assignee disclose a developing method allowing the toner transfer onto a plain paper with the use of insulating toner particles incorporating magnetic powder therein, wherein a magnetic blade positioned in the vicinity of the developer supporting means constantly and stably maintains a uniform developer layer on said supporting means, thus preventing the coagulation of the developer and enabling satisfactory image formation with stable developing density. More specifically a magnet roll is positioned in a non-magnetic developing sleeve, and a toner layer defining blade made of a magnet or a magnetic material is positioned corresponding to a magnetic pole of said magnet roll and spaced from said developing sleeve to define the thickness of the toner layer supported on said developing sleeve. The other magnetic pole of the magnetic roll is fixed in a position facing the latent image bearing means in the developing zone, and the image development is effected by rotating said developing sleeve in a same direction and at a substantially same peripheral speed with the latent image bearing means and in such a manner that said developing sleeve is spaced from said latent image bearing means by a distance larger than the thickness of said toner layer.

In such development an appropriate intensity of the developing electrode is important as it has a significant effect on the image quality, in contrast to the dry development with two-component toner in which the image quality is not essentially affected by the intensity of the developing electrode of the fixed magnet roll positioned in the rotary developing sleeve so as to face the developing zone. For example the developing function may be disabled if the developing electrode is excessively strong. Consequently in the development with one-component magnetic toner, an appropriate intensity of the developing electrode is essential for obtaining a satisfactory developed image.

On the other hand, as explained in the foregoing, the one-component toner generally tends to coagulate, thus resulting in various troubles. This tendency becomes stronger with the increase in the resistance of the toner, and is particularly marked in the insulating toner which is to be charged in the development. Such toner showing the coagulating tendency develops increasing coagulation when subjected to external force in the developing unit, thus hindering smooth transportation of the toner along with the rotating sleeve, eventually forming toner pool or disabling the developing function.

The developing device as explained in the foregoing is generally provided with elastic members, such as felt or moltprene, maintained in pressure contact with the lateral end portions of the developing sleeve for preventing the toner leaking beyond said lateral ends. In such structure, however, the toner particles are in a state of easily causing the coagulation because of the friction with said elastic members. Consequently the toner transporting force caused by the sleeve rotation is inevitably weakened, and there is easily generated a toner pool, which progressively develops in size, eventually causing toner leak from the developing device or direct toner contact with the latent image bearing means. Thus, in a developing device utilizing one-component magnetic toner a satisfactory image development may be hindered by such toner pool formation even if the intensity of the developing electrode is appropriately selected.

SUMMARY OF THE INVENTION

The object of the present invention is to provide a developing device not associated with the drawbacks of the prior devices and capable of providing a satisfactory image quality with a magnetic toner by the use of the developing electrode of an appropriate intensity.

Another object of the present invention is to provide a developing device capable of providing a sharp high-quality image without background fog.

Still another object of the present invention is to provide a developing device allowing image transfer onto plain paper with satisfactory image quality.

Still another object of the present invention is to provide a developing device capable of preventing the troubles resulting from toner coagulation principally associated with the use of one-component toner.

Still another object of the present invention is to provide a developing device allowing the recovery of the magnetic developer remaining on the developer supporting means into a developer reservoir while said developer is maintained on said supporting means.

Still another object of the present invention is to provide a developing device capable of avoiding the contamination caused by the remaining developer scattered from the developer supporting means.

According to the present invention, the above-mentioned objects are achieved by a developing device comprising developer supporting means provided in facing relation to latent image bearing means, developer supply means for supplying the developer to said developer supporting means, thickness defining means for uniformly defining the thickness of the developer supported on said developer supporting means, and magnetic field generating means for generating a magnetic field in a developing zone for developing a latent image on said latent image bearing means, said developer being a magnetic developer containing magnetic powder in a proportion not less than 20 wt.% and having a mean particle size not less than 5 microns, while said magnetic field generating means being adapted to generate a magnetic field of which flux intensity is not in excess of 950 gauss at the surface of the developer supporting means in the developing zone.

Furthermore the present invention is featured by a developing device comprising leak preventing means for preventing developer leak from the lateral end portions of said developer supporting means and a developer recovering magnetic pole at an angular position $\theta 1 < 45°$ downstream, in the rotating direction of the developer supporting means, of the initial contact position thereof with the leak preventing means. The developing device is further featured by another magnetic pole provided at an angular position $\theta 2$ upstream of said initial contact position, wherein said angle $\theta 2$ is defined by conditions $\theta 1 > \theta 2$ and $\theta 1 + \theta 2 \leqq 90°$.

The foregoing and still other objects and features of the present invention will be made apparent from the following description to be taken in conjunction with the attached drawings.

DESCRIPTION OF THE PREFERRED EMBODIMENTS

Figure 1:
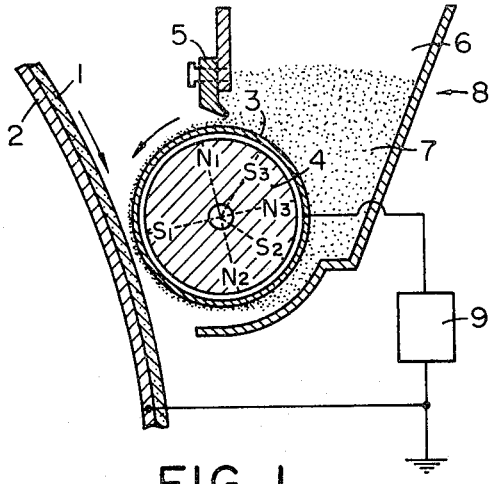
FIG. 1 is a cross-sectional view showing an embodiment of the developing device of the present invention.

In the following the present invention will be explained in detail by the embodiments thereof. Referring to FIG. 1 schematically showing an embodiment of the present invention, there are shown a CdS photosensitive member 1 surfacially covered with an insulating film (polyester film of 25 microns thick) and an electroconductive cylinder 2. A latent image can be formed on said photosensitive member by various methods, for example by positively charging the photosensitive drum with a primary charger, then subjecting said drum to an imagewise exposure substantially simultaneously with a secondary negative corona discharge and subsequently to a flush exposure to obtain an electrostatic latent image of an elevated contrast. The potential of said latent image is 500 V and 0 V respectively in the dark area and lighted area thereof. Said latent image is developed in a developing device 8, and the obtained image is transferred onto a plain paper by a corona discharge and fixed to obtain a satisfactory copy image.

In the developing device 8, a non-magnetic developing sleeve 3 encircling a magnet roll 4 therein is rotated in a same direction as represented in the drawing and at a substantially same peripheral speed with the latent image bearing surface. In the developing zone a developing magnetic pole S1 is positioned inside the developing sleeve 3 in facing relation to the electrostatic latent image. 5 is a thickness defining magnetic blade made of a magnetic material or a magnet and provided for applying the developer 7 with an appropriate thickness onto said developing sleeve 3. Thin developer layer formation on the developing sleeve with such magnetic blade is disclosed in detail in the United States Patent Application Ser. No. 938,494 of the present assignee. In the present example an iron blade is employed as said magnetic blade and positioned at a distance of 250 microns from the developing sleeve 3. Inside the developing sleeve 3 there is provided a magnetic pole N1 in facing relation to said blade 5. 6 is a hopper containing magnetic developer 7 therein. Said developing sleeve 3 is spaced from the latent image bearing surface, in the closest position in the developing zone, by a distance from 100 to 500$\mu$, preferably from 200 to 300$\mu$. In such structure, the thickness of the developer layer is maintained in a range from 50 to 300$\mu$, preferably from 100 to 200$\mu$. In the present example the developing device is positioned in such a manner that the developing sleeve is spaced by a distance of 300$\mu$ from the latent image bearing surface.

The magnetic developer to be employed in the image development should contain magnetic powder in a proportion not less than 20 wt.% as otherwise the particles of lower magnetic powder content are abundantly formed at the particle formation by crushing and inevitably mixed in the developer even after classification to provide an easily coagulable developer of low fluidity, which gives rise to an elevated fog level because of the difficulty in the uniform charging and of the reduced magnetic attraction by the developing sleeve.

On the other hand said magnetic powder content should preferably be maintained not in excess of 60 wt.% since a higher content will result in a deteriorated fixing property and a coarse image quality.

Also the developer particles are preferably provided with a mean particle size not less than 5 microns as otherwise the developer particles are strongly adhered by electrostatic attraction to the developing sleeve to hinder jumping up of the particles from the sleeve, thereby disabling satisfactory developing function, and a layer of fine developer particles formed on the surface of the developing sleeve prevents the new developer particles from contact charging with the developing sleeve, thus leading to deficient developer transfer and eventually resulting for example in a reduced developing density.

The developer referred to in the following description is a negatively chargeable insulating magnetic toner composed of ca. 80 parts by weight of a styrene resin and ca. 20 parts of magnetic powder, having a mean particle size of ca. 6$\mu$. Said developer is applied, on the developing sleeve 3, in a layer of a thickness of ca. 150$\mu$. At the development a developing bias voltage is applied between the developing sleeve 3 and the cylinder 2. Said bias voltage is generated by a power source 9, composed for example by an AC voltage generator disclosed in the United States Patent Applications Ser.

Nos. 58,343 and 58,435 of the present assignee. Said bias voltage is composed of an AC voltage with a frequency of 200 Hz and a peak voltage 800 $V_{pp}$, overlapped with a DC voltage of 200 V.

The aforementioned developing pole S1 and developer applying pole N1 of the magnetic roll 4 are preferably separated by a mutual angular separation of 90°, and there is also provided another magnetic pole N2 for recovering the developer into the hopper, in a manner as will be explained in the following, at an angular position of ca. 90° from said developing pole. The magnetic roll is further provided with a group of magnetic poles S2, N3 and S3 in succession respectively separated by 45°.

The magnetic field caused by said magnetic pole N1 of the magnet roll 4 positioned in facing relation to the thickness defining blade 5 has a flux density of ca. 800 gauss at the surface of the developing sleeve 3. However said surface flux density is not limited to the above-mentioned value but allows satisfactory developer application also at a level of 450 or 1100 gauss. Also a similar effect is achievable by enlarging the area of the pole N1, in which case the magnetic flux is concentrated to the magnetic blade to increase the flux density at said blade.

Experimental developments were carried out with various strengths of the developing pole S1 positioned inside the developing sleeve 3 in facing relation to the electrostatic latent image, and the image quality was compared with flux densities of 0, 200, 450, 800, 950 and 1000 gauss on the developing sleeve 3 in the developing zone. In these experiments it is found that the developed image tends to be associated with background fog in case of zero magnetic field while the developing density is extremely low in case of the magnetic field of 1000 gauss. The above-mentioned fog is significantly but not completely removed in the magnetic field of 200 gauss. Also in the magnetic field of 950 gauss, there is obtained a substantially improved image through the developing density is still somewhat low and the lines constituting characters appear thinner. The image obtained in the magnetic field of 450 or 800 gauss is of a high quality, with satisfactory developing density, sharpness and tonal rendition.

Also the image quality obtained with a magnetic developer of a mean particle size of 7–15μ was evaluated as a function of magnetic powder content varied from 10 to 60 wt.% and also of magnetic flux density caused by the developing pole S1 at the surface of the developing sleeve 3, said flux density being selected as 0, 200, 300, 450, 600, 800, 950 or 1000 gauss. The obtained results are summarized in Table 1, in which the image quality is classified into (A) a high-quality image without fog or loss of density, (B) a substantially satisfactory image without noticeable fog or density loss, (C) a highly fogged image or (D) an image with low density. It will be observed from Table 1 that a magnetic powder content lower than 10 wt.% results in fog formation regardless of the magnetic field intensity while a content higher than 60 wt.% results in deficient fixation or coarse image quality.

TABLE 1

| | Magnetic powder content (wt. %) | 10 | 20 | 30 | 40 | 50 | 60 |
|---|---|---|---|---|---|---|---|
| Surfacial magnetic field (gauss) | 0 | poor image quality with fog | C | C | C | C | deficient fixation and poor coarse image quality |
| | 200 | | C | C | C | C | |
| | 300 | | B | B | B | B | |
| | 450 | | A | A | A | B | |
| | 600 | | A | A | A | B | |
| | 800 | | A | A | B | B | |
| | 950 | | B | B | D | D | |
| | 1000 | | D | D | D | D | |

A: high-quality image
B: substantially satisfactory image
C: highly forgged image
D: low-density image Thus the flux density at the surface of the developing sleeve should not be in excess of 950 gauss as a higher flux density practically prohibits the developing function to result in a very low image density. Also said flux density is preferably not less than 300 gauss as the fog formation becomes apparent in a weaker magnetic field. Further, in order to obtain a high-quality image, said flux density is more preferably selected in a range of 450 to 800 gauss.

As explained in the foregoing, the present invention which is featured by a developing device comprising developer supporting means 3 positioned in facing relation to the latent image bearing means, developer supply means 6 for supplying magnetic developer 7 containing magnetic powder in a proportion not less than 20 wt.% and having a mean particle size not less than 5 microns to said developer supporting means, thickness defining means 5 for defining the developer present on said developer supporting means to a thickness smaller than the distance between said latent image bearing means and said developer supporting means, and means for generating a magnetic field at least in the developing zone with a flux density not in excess of 950 gauss at the surface of said developer supporting means, allows to obtain a high-quality fogfree image by use of insulating magnetic toner. Also said image is transferable onto plain paper with satisfactory image quality. In this manner the development with one-component magnetic toner is rendered possible.

Figure 2:
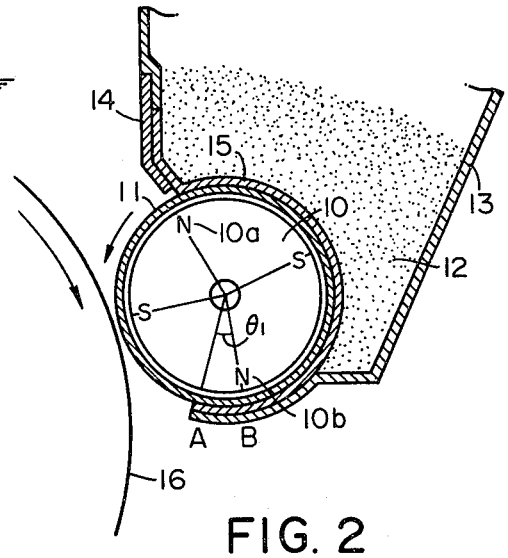
FIG. 2 is a cross-sectional view of an embodiment of the developing device of the present invention having end treating members at the lateral end portions of the developer supporting means.

Now there will be explained other embodiments shown in FIGS. 2 and 3 for preventing the toner coagulation. In FIG. 2 there are shown a permanent magnet 10 with plural poles, a sleeve 11 encircling said permanent magnet, a magnetic developer 12 supplied onto said sleeve, a toner reservoir 13 containing said magnetic developer, a toner applying member 14 for forming a toner layer of a determined thickness on said sleeve, end treating members 15 formed of an elastic material such as felt or moltprene and positioned in pressure contact with the lateral end portions of said sleeve to prevent toner leak from said end portions, and a latent image bearing member 16 positioned in spaced relation to said sleeve.

In such structure the toner is transported along the rotation of the sleeve, and the toner is in a state of easily causing coagulation at the end portions of the aperture of the reservoir 13 because of the friction with said members 15. Consequently, in the conventional developing devices, the toner transporting force is weakened and a toner pool tends to be created in the portion A where the sleeve 11 comes into initial contact with the end treating members 15. Such toner pool, once generated, develops progressively, eventually leading to toner leaking from the developing device or to the direct contact of the toner with the latent image bearing member.

The present inventors have however found that such phenomenon can be prevented by magnetic field generating means positioned downstream and in the vicinity of said position A for transporting the toner present in such position into the toner reservoir, and have thus reached the present invention which will be explained in detail by an embodiment thereof.

In the developing device shown in FIG. 2, there is employed a magnet roll 10 having four magnetic poles. An iron blade 14 is positioned above said sleeve and in facing relation to a principal pole 10*a* having a magnetic field strength of 1000 gauss on the surface of said sleeve for defining the toner layer on said sleeve to a thickness of ca. 80 microns. The magnetic toner 12 is crushed mixture of 78 parts of a styrene-maleic acid resin, 18 parts of ferrite, 2 parts of a charge control agent and 2 parts of carbon black, to which 0.1 wt.% amount of colloidal silica is added for improving the fluidity and charging property. Leak preventing members 15 made of woolen felt are provided so as to come into contact with the sleeve 11 at the position A. In the above-explained structure, the satisfactory toner transportation is assured by a principal pole 10*b* generating a flux density of at least 400 gauss at the sleeve surface and provided at a downstream position B separated from said position A by an angle $\theta 1$ smaller than 45°.

Figure 3:
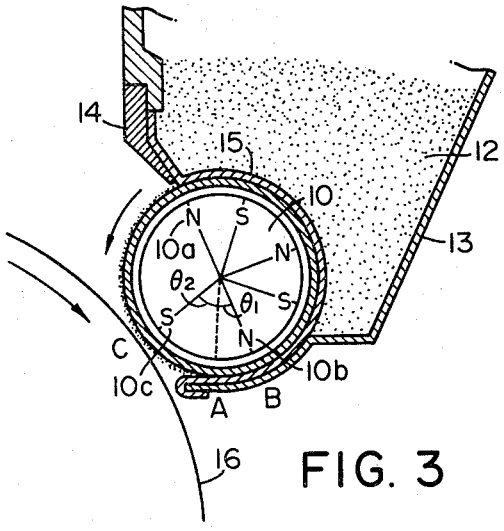
FIG. 3 is a cross-sectional view showing still another embodiment of the present invention.

FIG. 3 shows another embodiment having another magnetic pole positioned upstream and in the vicinity of said position A with respect to the sleeve rotation, wherein components common with those shown in FIG. 2 are represented by same members and omitted from the following explanation. In this case the toner retention at the position A is further facilitated by said upstream magnetic pole. In the illustrated example the magnetic defining member 14 is spaced by a distance of 250 microns from the sleeve surface and positioned in facing relation to the magnetic principal pole 10*a* generating a flux density of 850 gauss on the sleeve surface. The magnetic toner 12 is same as explained in relation to the embodiment of FIG. 2 or is composed of crushed mixture of 48 parts of a styrene resin, 50 parts of magnetite and 2 parts of a charge control agent, and is applied in a thickness of ca. 100 or 60 microns respectively in the former or latter composition. At the developing position C there is provided a magnetic pole 10*c* to generate a flux density of ca. 650 gauss on the sleeve surface. It is also possible to provide a transporting pole between the position A and the developing pole S, and to define such transporting pole as said pole 10*c* and the position thereof as said position C. The position A represents the initial contact position of the sleeve 11 with leak preventing members 15 made of teflon felt. A magnetic pole 10*b* for assisting toner transportation is positioned at B, and satisfactory toner transportation without toner coagulation or toner pool formation can be assured under the conditions $\theta 1 < 45°$ and $\theta 1 < \theta 2$. These conditions are derived from facts that magnetic transportion of toner from the position A into the toner reservoir becomes difficult for an angle $\theta 1$ in excess of 45°, and that the pole 10*c* has a larger effect than the pole 10*b* on the toner to retain the toner in the position A if the angle $\theta 1$ is larger than the angle $\theta 2$.

Furthermore satisfactory development is assured when said angles are selected so as to satisfy the condition $\theta 1 + \theta 2 \leqq 90°$ as otherwise said poles are excessively distant so that the toner particles are attracted by respective poles and prevented from smooth transportation.

The above-mentioned conditions for the angles $\theta 1$ and $\theta 2$ allows to prevent toner pool formation in the afore-mentioned position A, eventual toner scattering therefrom and defective development caused by toner coagulation in the developing zone C.

In FIG. 2 there is shown an embodiment in which the developing pole S and the transporting pole N are separated by $\theta 1 + \theta 2 = 90°$, while FIG. 3 shows a case of $\theta 1 = 25°$, $\theta 2 = 50°$ and $\theta 1 + \theta 2 = 75°$. Furthermore, in the embodiment of FIG. 3 there are provided a group of magnetic poles S, N and S separated in succession by ca. 45° behind the position B in a similar manner as shown in FIG. 1 to ensure the toner transportation.

The present invention is however not limited to the foregoing embodiments but is also applicable in a general manner to:

(1) a developing device for developing a latent image by a magnetic developer supplied to a non-magnetic rotary member encircling a magnetic field generating means, comprising developer leak preventing means provided in facing relation to said non-magnetic rotary member, and a magnetic pole provided in a downstream angular position $\theta 1$ in the vicinity of said preventing means with respect to rotating direction of said rotary member, said angle $\theta 1$ being selected smaller than 45°:

(2) a developing device for developing a latent image by a magnetic developer supplied to a non-magnetic rotary member encircling a magnetic field generating means, comprising developer leak preventing means provided in facing relation to said non-magnetic rotary member, and magnetic poles provided respectively in downstream and upstream angular positions $\theta 1$ and $\theta 2$ of said preventing means with respect to the rotating direction of said rotary member, said angles being defined by the conditions $\theta 1 < 45°$ and $\theta 1 < \theta 2$:

(3) a developing device provided with a non-magnetic sleeve encircling magnetic field generating means therein, a reservoir for supplying magnetic developer, applying means for applying said magnetic developer onto said sleeve and end treating members for preventing the leak of said developer from lateral end portions of said sleeve, wherein one of said magnetic field generating means is positioned inside said sleeve corresponding to a sleeve surface position B downstream of the initial contact position A of the sleeve surface with said end treating members in the sleeve rotation through a position of developer application and a position for development, said position B being separated from said position A by a center angle not exceeding 45°, and said magnetic field generating means being adapted to generate a flux density of at least 400 gauss at said position B:

(4) a developing device further comprising another magnetic field generating means corresponding to an upstream position C with respect to said position A, the angle $\theta 1$ between said positions A and B at the sleeve center being smaller than the angle $\theta 2$ between said positions A and C:

(5) a developing device in which the angles $\theta 1$ and $\theta 2$ described in the foregoing paragraphs (2) and (4) are selected so as to satisfy a condition $\theta 1+\theta 2 \leqq 90°$; and (6) a developing device as described in the foregoing paragraphs (1) to (5), comprising the use of a magnetic developer containing magnetic powder in a proportion not less than 20 wt.% and having a mean particle size not less than 5 microns, and a magnetic flux density not in excess of 950 gauss at the sleeve surface in the developing zone. As detailedly explained in the foregoing, the present invention provides the following effects:

(1) that the magnetic developer remaining on the non-magnetic rotary member after the development can be retained on said member and directed recovered into the developer reservoir:

(2) that said recovery can be effected without developer coagulation or pool formation through the use of afore-mentioned magnetic poles, thus allowing repeated developing operations:

(3) that the contamination by scattering of said remaining developer from said rotary member is completely prevented: and (4) that the absence of coagulation of said remaining developer allows to prevent eventual deterioration in the image quality or uneven developing density.

What we claim is:

1. A developing device for developing a latent image supported on latent image bearing means by supplying a developer thereto, comprising:

developer supporting means provided in facing relation to said latent image bearing means;

developer supply means for supplying the developer supporting means;

thickness controlling means for adjusting the developer present on said developer supporting means to a uniform thickness wherein said thickness controlling means adjusts the developer thickness to a value smaller than the distance between said latent image bearing means and said developer supporting means, thereby forming a clearance between said latent image bearing means and the developer layer; and magnetic field generating means for generating a magnetic field in a developing zone for developing the latent image supported on said latent image bearing means;

wherein said developer is a magnetic developer containing magnetic powder in a proportion not less than 20 wt.% ; and wherein said magnetic field generating means is stationary and adapted to generate a flux density not in excess of 950 gauss on the surface of said developer supporting means in the developing zone.

2. A developing device according to claim 1, wherein said magnetic field generating means is adapted to generate a flux density not less than 300 gauss at the surface of said developer supporting means in the developing zone.

3. A developing device according to the claim 1, wherein said magnetic developer has a magnetic powder content not in excess of 60 wt.%.

4. A developing device according to the claim 1, wherein said thickness defining means is a magnetic blade.

5. A developing device according to the claim 4, further comprising a magnetic pole inside said developer supporting means and in facing relation to said magnetic blade.

6. A developing device according to the claim 5, wherein said magnetic pole is adapted to generate a flux density in a range of 450 to 1100 gauss at the surface of said developer supporting means.

7. A developing device according to the claim 1, wherein said thickness defining means is adapted to define the developer thickness to a value smaller than the distance between said latent image bearing means and said developer supporting means, thereby forming a clearance between said latent image bearing means and the developer layer.

8. A developing device according to the claim 7, wherein an AC electric field is applied to said clearance.

9. A developing device according to the claim 7, wherein the distance between said developer supporting means and said latent image bearing means is in a range from 150 to 500 microns.

10. A developing device according to the claim 7, wherein the distance between said developer supporting means and said latent image bearing means is in a range from 200 to 300 microns.

11. A developing device according to the claim 7, wherein the thickness of the developer layer is in a range from 50 to 300 microns.

12. A developing device according to the claim 7, wherein the thickness of the developer layer is in a range from 100 to 200 microns.

13. A developing device according to the claim 1, wherein said developer is electroinsulating.

14. A developing device according to the claim 13, wherein an AC electric field is applied in the clearance between said latent image bearing means and the developer layer.

15. A developing device according to the claim 1, wherein the angular distance between the magnetic pole contributing to the development and an adjacent magnetic pole positioned downstream in the rotary direction of the developer supporting means is equal to or smaller than 90°.

16. A developing device according to the claim 1, further comprising means for preventing developer from leaking from the lateral end portions of said developer supporting means, and a developer recovering magnetic pole positioned downstream of, in the rotary direction of said developer supporting means, and at an angular distance $\theta 1$ smaller than 45° from an initial contact position of the developer supporting means with said leak preventing means.

17. A developing device according to the claim 16, wherein said magnetic pole at said angular position $\theta 1$ is adapted to generate a flux density not less than 400 gauss at the surface of the developer supporting means.

18. A developing device according to the claim 16 or 17, further comprising another magnetic pole positioned upstream of, in the rotary direction of the developer supporting means, and at an angular position $\theta 2$ from the initial contact position of the developer supporting means with the leak preventing means, said angle $\theta 2$ being larger than the angle $\theta 1$.

19. A developing device according to the claim 18, wherein said angles $\theta 1$ and $\theta 2$ are selected to satisfy a condition $\theta 1+\theta 2 \leqq 90°$.

20. A developing device according to the claim 18, wherein the magnetic pole at said angular position $\theta 2$ is the developing magnetic pole.

21. A developing device according to the claim 16, further comprising a magnetic pole in facing relation to the thickness defining means, and transporting poles positioned between the above-mentioned magnetic pole and said developer recovering magnetic pole and mutually separated by minimum angular distances required for toner transportation on the developer supporting means.

22. A developing device according to the claim 21, comprising three transporting poles.

23. A developing device for developing a latent image supported on latent image bearing means by supplying a developer thereto, comprising:

developer supporting means provided in facing relation to said latent image bearing means;

developer supply means for supplying the developer to said developer supporting means;

thickness defining means for defining the developer from present on said developer supporting means into a uniform thickness;

magnetic field generating means for generating a magnetic field in a developing zone for developing the latent image supported on said latent image bearing means;

leak preventing means for preventing developer from leaking from the lateral end portions of said developer supporting means; and a developer recovering magnetic pole positioned downstream, of, in the rotary direction of the developer supporting means, and at an angular position $\theta 1$ smaller than 45° from the initial contact position of said developer supporting means with said leak preventing means.

24. A developing device according to the claim 23, wherein the magnetic pole at said angular position $\theta 1$ is adapted to generate a flux density not less than 400 gauss at the surface of the developer supporting means.

25. A developing device according to the claim 23 or 24, further comprising another magnetic pole positioned upstream of, in the rotary direction of the developer supporting means, and at an angular position $\theta 2$ from the initial contact position of the developer supporting means with the leak preventing means, said angle $\theta 2$ being larger than the angle $\theta 1$.

26. A developing device according to the claim 25, wherein said angles $\theta 1$ and $\theta 2$ are selected to satisfy a condition $\theta 1+\theta 2 \leqq 90°$.

27. A developing device according to the claim 25, wherein the magnetic pole at said angular position $\theta 2$ is the developing magnetic pole.

28. A developing device according to the claim 23, further comprising a magnetic pole in facing relation to the thickness defining means, and transporting poles positioned between the above-mentioned magnetic pole and said developer recovering magnetic pole and mutually separated by minimum angular distances required for toner transportation on the developer supporting means.

29. A developing device according to the claim 28, comprising three transporting poles.

30. A developing device according to claim 1, where said magnetic powder of said magnetic developer has a mean particle size not less than 5 microns.

* * * * *